US012446708B2

(12) United States Patent
Yang

(10) Patent No.: US 12,446,708 B2
(45) Date of Patent: Oct. 21, 2025

(54) CRIB

(71) Applicant: TJ(fujian) Industrial Co.,Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 386 days.

(21) Appl. No.: 18/090,556

(22) Filed: Dec. 29, 2022

(65) Prior Publication Data

US 2023/0200558 A1 Jun. 29, 2023

(30) Foreign Application Priority Data

Dec. 29, 2021 (CN) ..... 202123362485.3

(51) Int. Cl.
*A47D 9/00* (2006.01)

(52) U.S. Cl.
CPC ..... *A47D 9/012* (2022.08)

(58) Field of Classification Search
CPC ..... A47D 9/00; A47D 9/005; A47D 9/008; A47D 9/012; A47D 9/016; A47D 9/02; A47D 9/04; A47D 9/053; A47D 11/00; A47D 11/005; A47D 11/007; A47D 13/00; A47D 13/02
See application file for complete search history.

(56) References Cited

U.S. PATENT DOCUMENTS

| | | | | |
|---|---|---|---|---|
| 2015/0173523 | A1* | 6/2015 | Horst | A47D 9/016 5/655 |
| 2016/0106226 | A1* | 4/2016 | Yi | A47D 9/012 5/11 |
| 2018/0192784 | A1* | 7/2018 | Yang | A47D 9/012 |
| 2019/0099012 | A1* | 4/2019 | Zhang | A47D 15/00 |
| 2021/0076841 | A1* | 3/2021 | Hu | A47D 9/012 |
| 2022/0007853 | A1* | 1/2022 | Guo | A47D 9/012 |
| 2023/0165387 | A1* | 6/2023 | Tuckey | A47D 9/057 5/105 |
| 2023/0346134 | A1* | 11/2023 | Yang | A47D 7/01 |

FOREIGN PATENT DOCUMENTS

| | | | |
|---|---|---|---|
| CN | 209898878 U | | 1/2020 |
| CN | 212546366 U | * | 2/2021 |

* cited by examiner

*Primary Examiner* — George Sun
(74) *Attorney, Agent, or Firm* — Bayramoglu Law Offices LLC

(57) ABSTRACT

A crib includes a left support portion, a right support portion and a sleeping basket. Each of the left and right support portions includes a base, a support rod and a sleeve rod. The support rod is provided with a bottom portion connected to a top portion of the base and an upper portion nested in a lower portion of the sleeve rod. The sleeping basket is provided between the sleeve rod of the left support portion and the sleeve rod of the right support portion. An outer side of a bottom portion of the sleeve rod is provided with a double-lock assembly. The double-lock assembly includes a mounting portion, a pulling portion and a pressing portion. The mounting portion is connected to the sleeve rod. The pulling portion and the pressing portion are arranged on the mounting portion, and the pulling portion is located above the pressing portion.

9 Claims, 8 Drawing Sheets

CRIB

CROSS REFERENCE TO THE RELATED APPLICATIONS

This application is based upon and claims priority to Chinese Patent Application No. 202123362485.3, filed on Dec. 29, 2021, the entire contents of which are incorporated herein by reference.

TECHNICAL FIELD

The present invention relates to the field of children's products, in particular to a crib.

BACKGROUND

Cribs are specially designed for infants. The existing cribs have various styles, and their functions and prices vary greatly. In order to meet the requirements for different operational heights, the existing cribs are designed to be height-adjustable, which makes the cribs user-friendly. In the prior art, a height-adjustable crib includes a left support portion, a right support portion and a sleeping basket. Each of the left support portion and the right support portion includes a base, two support rods and a sleeve rod. Each of the two support rods is provided with a bottom portion connected to a top portion of the base and an upper portion nested in a lower portion of the sleeve rod. An upper portion of the sleeve rod is provided with a key for driving the sleeve rod to move up and down on the two support rods. The sleeping basket is provided between the sleeve rod of the left support portion and the sleeve rod of the right support portion. The key drives the sleeve rod to move up and down on the two support rods, thereby driving the sleeping basket to move up and down. However, the key used alone is prone to misoperation, thereby causing a safety hazard during use of the crib.

SUMMARY

In order to solve the above-mentioned problem existing in the prior art, an objective of the present invention is to provide a crib.

The present invention is implemented by the following technical solution:

A crib includes a left support portion, a right support portion and a sleeping basket, where each of the left support portion and the right support portion includes a base, a support rod and a sleeve rod; the support rod is provided with a bottom portion connected to a top portion of the base and an upper portion nested in a lower portion of the sleeve rod; the sleeping basket is provided between the sleeve rod of the left support portion and the sleeve rod of the right support portion; an outer side of a bottom portion of the sleeve rod is provided with a double-lock assembly; the double-lock assembly includes a mounting portion, a pulling portion for pulling and a pressing portion for pressing; the mounting portion is connected to the sleeve rod; the pulling portion and the pressing portion are arranged on the mounting portion, and the pulling portion is located above the pressing portion; when the pulling portion is not pulled upward, the pulling portion blocks the pressing portion; an inner side of the pressing portion is provided with a clamping portion; an outer side of a lower portion of the support rod is provided with a plurality of clamping slots arranged vertically; and the clamping portion passes through the mounting portion and the sleeve rod to be clamped into the clamping slot.

Further, a mounting slot may be provided on an outer side of the mounting portion; an inner side of the pulling portion may be provided with a spring mounting seat located in the mounting slot and two side plates spaced apart; the spring mounting seat may be provided between the two side plates; the two side plates may be respectively provided with strip slots; a first pin connected to the mounting portion may pass through the strip slots of the two side plates; middle portions of two sides of the pulling portion may be respectively provided with upper clamping edge portions, an upper portion of the mounting portion may be provided with two lower clamping edge portions, and each of the lower clamping edge portions may be corresponding to one upper clamping edge portion; the upper clamping edge portions may be able to abut against the lower clamping edge portions, respectively; and a first spring may be provided between the spring mounting seat and an inner top surface of the mounting slot.

Further, an inner side of the pressing portion may be provided with a spring mounting post and two hinge portions spaced apart; a second pin hinged to the mounting portion may pass through the two hinge portions; the mounting slot may be internally provided with a spring slot; a second spring may be provided between the spring slot and the spring mounting post; and the spring mounting post, the two hinge portions and the clamping portion may be respectively located at upper, middle and lower portions of the inner side of the pressing portion.

Further, a bottom portion of an inner side of the pulling portion may be provided with an abutting portion; a top portion of the inner side of the pressing portion may be provided with an abutting slot adapted to the abutting portion; and when the pulling portion may be not pulled upward, an outer side of the abutting portion may abut against an inner side of the abutting slot.

Further, the bottom portion of the sleeve rod may be internally provided with a sleeve piece through which the support rod may pass; the sleeve piece may be connected to the mounting portion; and the outer side of the bottom portion of the sleeve rod may be provided with a first notch for accommodating a joint between the sleeve piece and the mounting portion.

Further, the base may include an outer tube, an intermediate tube and an inner tube; the intermediate tube may be fixed in the outer tube; one end of the inner tube may be located in the intermediate tube, and the other end of the inner tube may extend out of the outer tube and be fixedly connected to one end of a connecting piece; and the inner tube may be retractable relative to the intermediate tube.

Further, the connecting piece may be internally provided with an elastic piece slot; a top surface of the connecting piece may be provided with a clamping hole; the elastic piece slot may be internally provided with a V-shaped elastic piece; the V-shaped elastic piece may be provided with a clamping head; the clamping head protrudes out of the clamping hole and may be located at one side of the outer tube; and the intermediate tube may be internally provided with a third spring abutting against the one end of the inner tube.

Further, the outer tube may be provided with an arc-shaped bottom surface; and each of one end of the outer tube and the other end of the connecting piece may be provided with a rotatable caster.

Further, each of the one end of the outer tube and the other end of the connecting piece may be provided with a second notch; each of the one end of the outer tube and the other end of the connecting piece may be internally provided with a pivoting assembly; the pivoting assembly may include a rotating member and a sliding member; a top portion of the caster may be connected to the rotating member; the rotating member may be correspondingly hinged to the outer tube/connecting piece; an outer periphery of the rotating member may be provided with two sockets spaced apart; the rotating member may be located in the second notch; the sliding member may be provided with an insertion portion and a sliding button; the insertion portion may be able to be inserted into the socket; the sliding button protrudes out of the outer tube/connecting piece; and each of the one end of the outer tube and the other end of the connecting piece may be internally provided with a fourth spring abutting against the sliding member.

Further, the sleeping basket may include an upper enclosure frame, a support frame and an enclosure cloth; the upper enclosure frame may be provided above the support frame; the enclosure cloth may be provided between the upper enclosure frame and the support frame; the upper enclosure frame may include a U-shaped tube, a left connecting tube, a right connecting tube and a detachable tube; two ends of the U-shaped tube may respectively pass through a top portion of the sleeve rod of the left support portion and a top portion of the sleeve rod of the right support portion to be respectively connected to the left connecting tube and the right connecting tube; the detachable tube may be detachably provided between the left connecting tube and the right connecting tube; each of two ends of the detachable tube may be internally provided with a movable member and a fifth spring; the movable member may have a bottom portion provided with a push portion, one end surface provided with an insertion rod and the other end surface abutting against the fifth spring; an end surface of each of the left connecting tube and the right connecting tube may be provided with an insertion slot for an insertion of the insertion rod; an end portion of each of the left connecting tube and the right connecting tube may be provided with a positioning portion; and each of two ends of the detachable tube may be provided with a positioning slot adapted to the positioning portion.

According to the description of the present invention, compared with the prior art, the present invention has the following advantages.

1. The present invention has a novel structure and clever design. When it is necessary to adjust the height of the crib, first, the pulling portions are pulled upward such that there is no obstruction between the pulling portions and the pressing portions. Then, the pressing portions are pressed to disengage the clamping portions from the matched clamping slots. At this time, the sleeve rods can be pulled so as to adjust the height of the sleeping basket. When the sleeve rods and the sleeping basket are adjusted to desired heights, the pressing portions are released, and the clamping portions are re-clamped into new clamping slots. Finally, the pulling portions are released such that the pulling portions block the pressing portions. In the present invention, when the heights of the sleeve rods and the sleeping basket are adjusted, double locking structures are used, that is, the pulling portions and the pressing portions. In this way, misoperation caused by pressing the pressing portions directly is prevented, thereby improving the operational safety of the crib.

2. When the casters are in contact with the ground, the crib is used as an ordinary crib, and the casters are convenient to move the crib. When the casters are rotated and disengaged from the ground, the bottom surfaces of the outer tubes are in contact with the ground. Since the bottom surfaces of the outer tubes are arc-shaped surfaces, the crib can be rocked and used as a cradle.

DETAILED DESCRIPTION OF THE EMBODIMENTS

Figure 1:
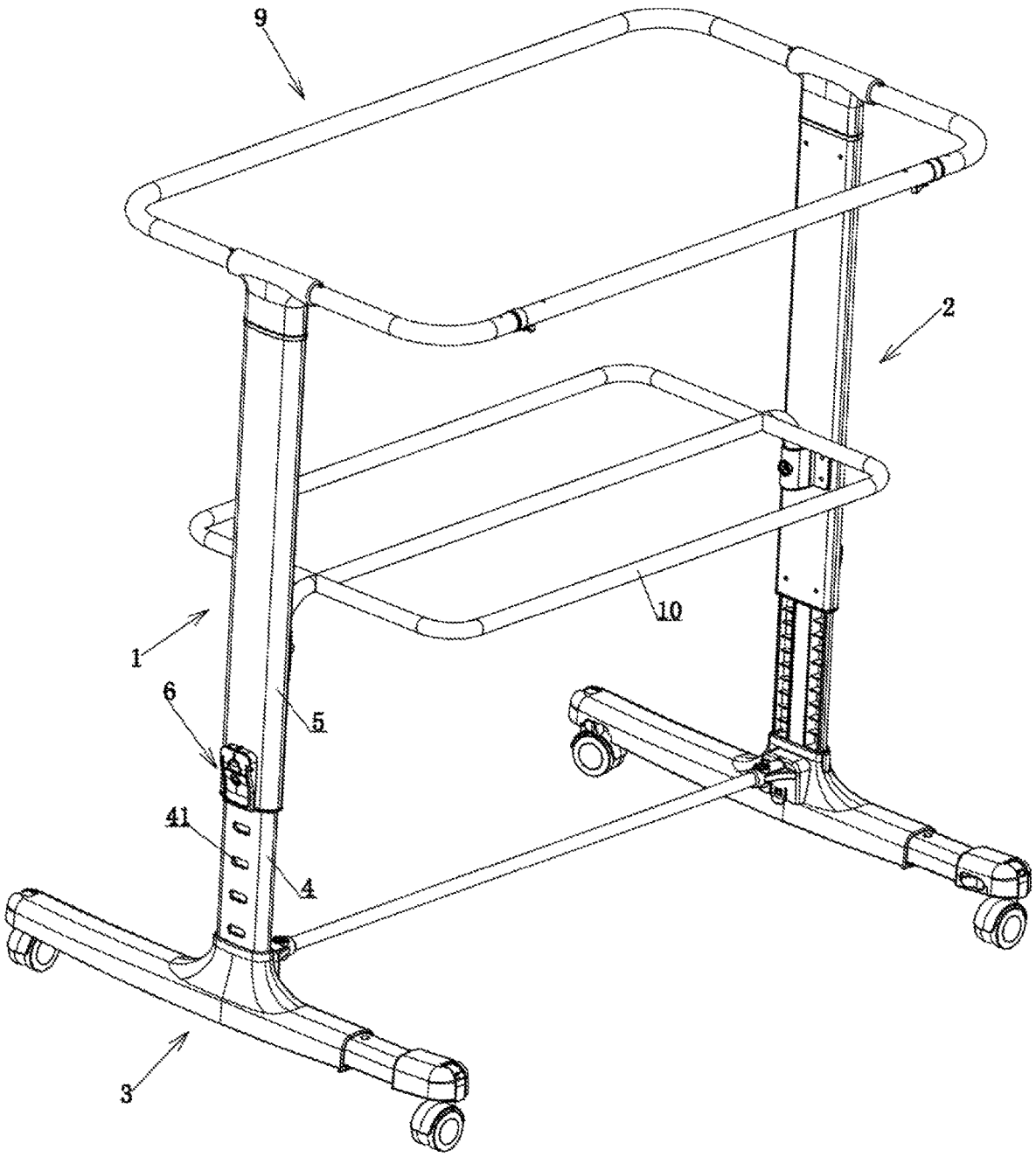
FIG. 1 is a structural view of a crib according to the present invention.

Referring to FIGS. 1 to 6, a crib includes a left support portion 1, a right support portion 2 and a sleeping basket. Each of the left support portion 1 and the right support portion 2 includes a base 3, a support rod 4 and a sleeve rod 5. The support rod 4 is provided with a bottom portion connected to a top portion of the base 3 and an upper portion nested in a lower portion of the sleeve rod 5. The sleeping basket is provided between the sleeve rod 5 of the left support portion 1 and the sleeve rod 5 of the right support portion 2. An outer side of a bottom portion of the sleeve rod 5 is provided with a double-lock assembly 6. The double-lock assembly 6 includes a mounting portion 61, a pulling portion 62 for pulling and a pressing portion 63 for pressing. The mounting portion 61 is connected to the sleeve rod 5. The pulling portion 62 and the pressing portion 63 are arranged on the mounting portion 61, and the pulling portion 62 is located above the pressing portion 63. When the pulling portion is not pulled upward, the pulling portion 62 blocks the pressing portion 63. An inner side of the pressing portion 63 is provided with a clamping portion 631. An outer side of a lower portion of the support rod 4 is provided with a plurality of clamping slots 41 arranged vertically. The clamping portion 631 passes through the mounting portion 61 and the sleeve rod 5 to be clamped into the clamping slot 41.

Referring to FIGS. 3 to 6, a mounting slot 611 is provided on an outer side of the mounting portion 61. An inner side of the pulling portion 62 is provided with a spring mounting seat 621 located in the mounting slot 611 and two side plates 622 spaced apart. The spring mounting seat 621 is provided between the two side plates 622. The two side plates 622 are respectively provided with strip slots 623. A first pin connected to the mounting portion 61 passes through the strip slots 623 of the two side plates 622. Middle portions of two sides of the pulling portion 62 are respectively provided with upper clamping edge portions 624, and an upper portion of the mounting portion 61 is provided with two lower clamping edge portions 612. Each of the lower clamping edge portions 612 is corresponding to one upper clamping edge portion 624, and the upper clamping edge portions 624 are able to abut against the lower clamping edge portions 612, respectively. A first spring 625 is provided between the spring mounting seat 621 and an inner top surface of the mounting slot 611. The pulling portion 62 is able to be pulled upward, and when the pulling portion 62 is not pulled upward, the upper clamping edge portions 624 respectively abut against the lower clamping edge portions 612.

Referring to FIGS. 3 to 6, an inner side of the pressing portion 63 is provided with a spring mounting post 632 and two hinge portions 633 spaced apart. A second pin hinged to the mounting portion 61 passes through the two hinge portions 633. The mounting slot 611 is internally provided with a spring slot 613. A second spring 634 is provided between the spring slot 613 and the spring mounting post 632. The spring mounting post 632, the two hinge portions 633 and the clamping portion 631 are respectively located at upper, middle and lower portions of the inner side of the pressing portion 63. A bottom portion of an inner side of the pulling portion 62 is provided with an abutting portion 626. A top portion of the inner side of the pressing portion 63 is provided with an abutting slot 635 adapted to the abutting portion 626. When the pulling portion 62 is not pulled upward, an outer side of the abutting portion 626 abuts against an inner side of the abutting slot 635.

Referring to FIGS. 3 to 6, when the pulling portion 62 is not pulled upward, the outer side of the abutting portion 626 abuts against the inner side of the abutting slot 635. At this time, the pressing portion 63 cannot be pressed, and the heights of the sleeve rod 5 and the sleeping basket cannot be adjusted. When the heights of the sleeve rod 5 and the sleeping basket need to be adjusted, the pulling portion 62 is firstly pulled upward, such that the abutting portion 626 is disengaged from the abutting slot 635. At this time, an upper half of the pressing portion 63 can be pressed. When the upper half of the pressing portion 63 is pressed, a lower half of the pressing portion 63 moves outward, such that the clamping portion 631 is disengaged from the clamping slot 41 matched with the support rod 4. At this time, the height of the sleeve rod 5 can be adjusted. When the sleeve rod 5 is adjusted to a desired height, the pressing portion 63 is released. The pressing portion 63 automatically returns under the action of the second spring 634, and the clamping portion 631 is clamped into a new clamping slot 41. Then, the pulling portion 62 is released, and the pulling portion 62 returns automatically under the action of the first spring 625. After the lifting portion 62 automatically returns, the outer side of the abutting portion 626 and the inner side of the abutting slot 635 abut against each other again.

Figure 3:
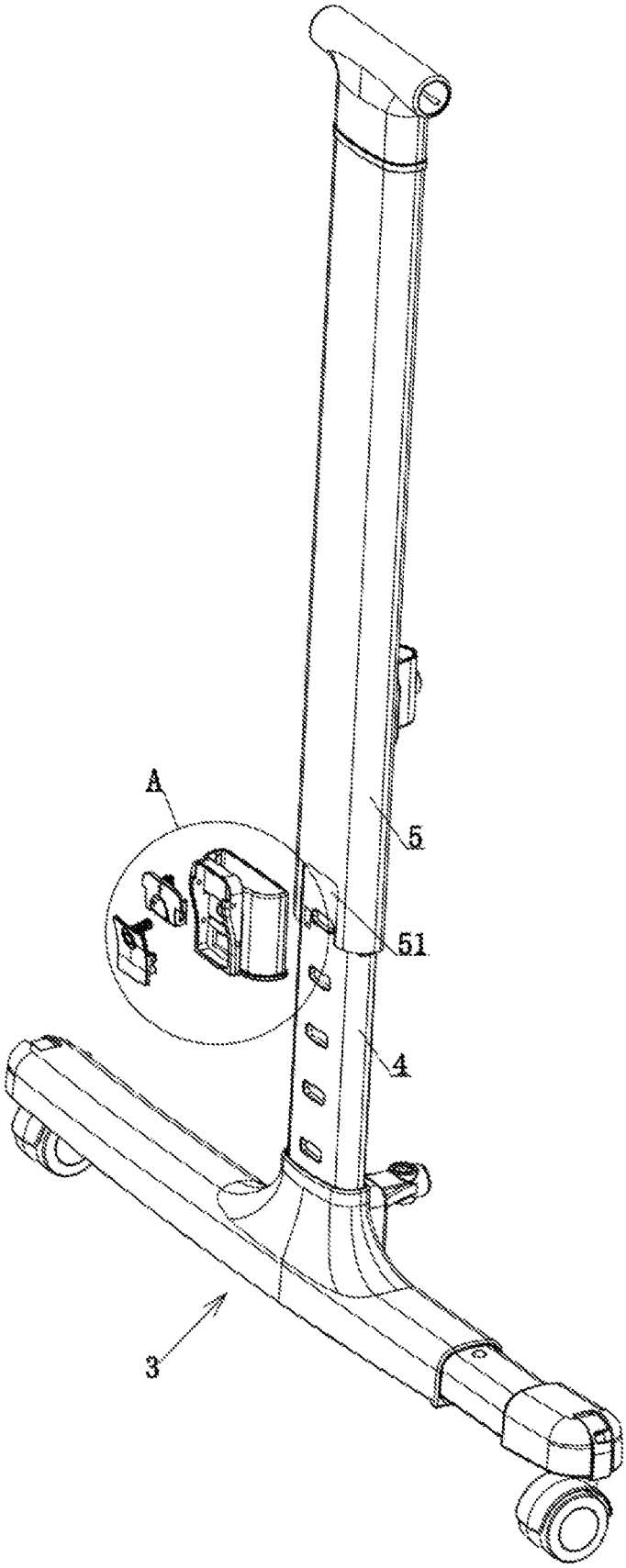
FIG. 3 is a partial exploded view of the left support portion according to the present invention.
Figure 4:
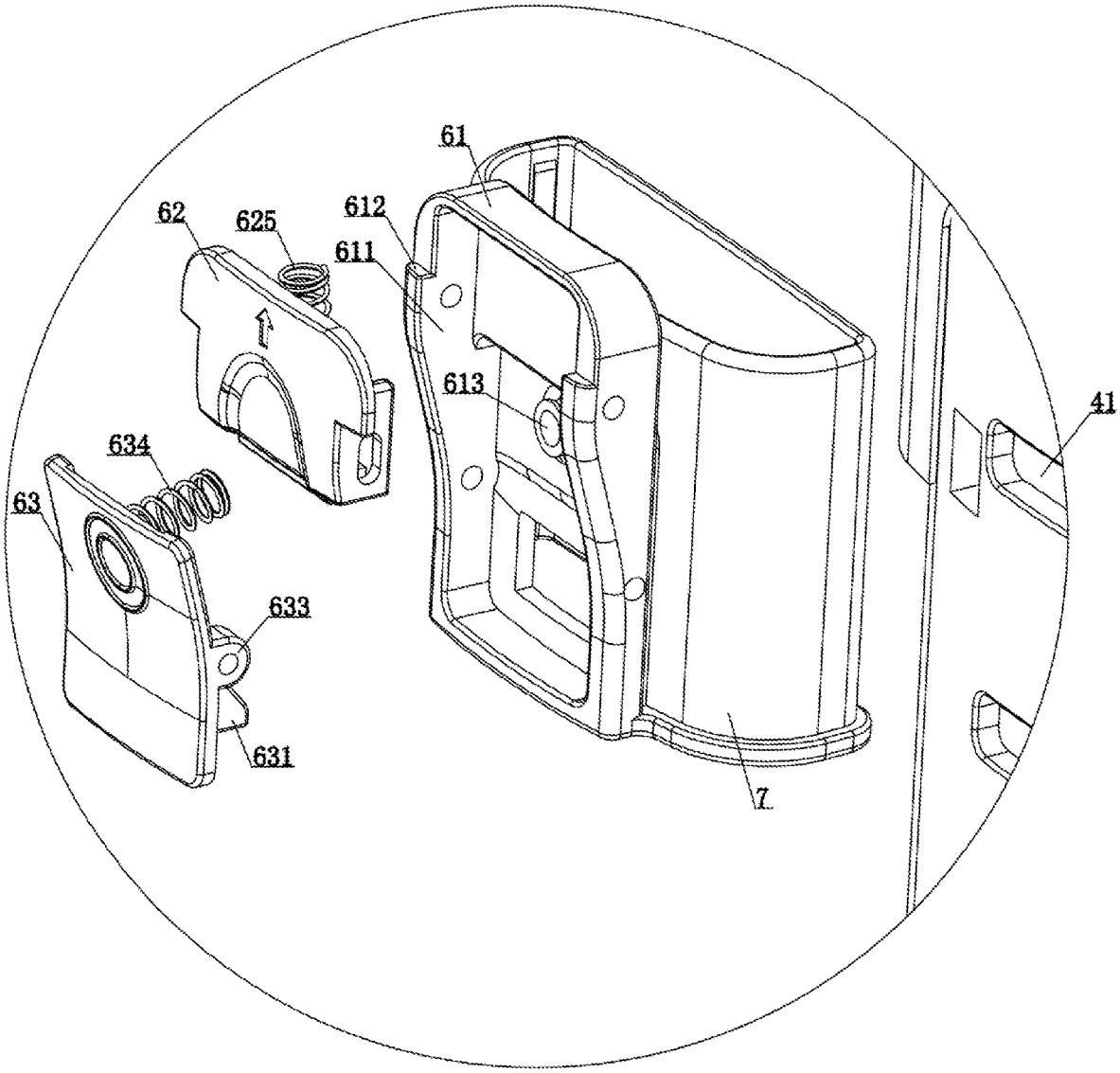
FIG. 4 is a partial enlarged view of A shown in FIG. 3.
Figure 5:
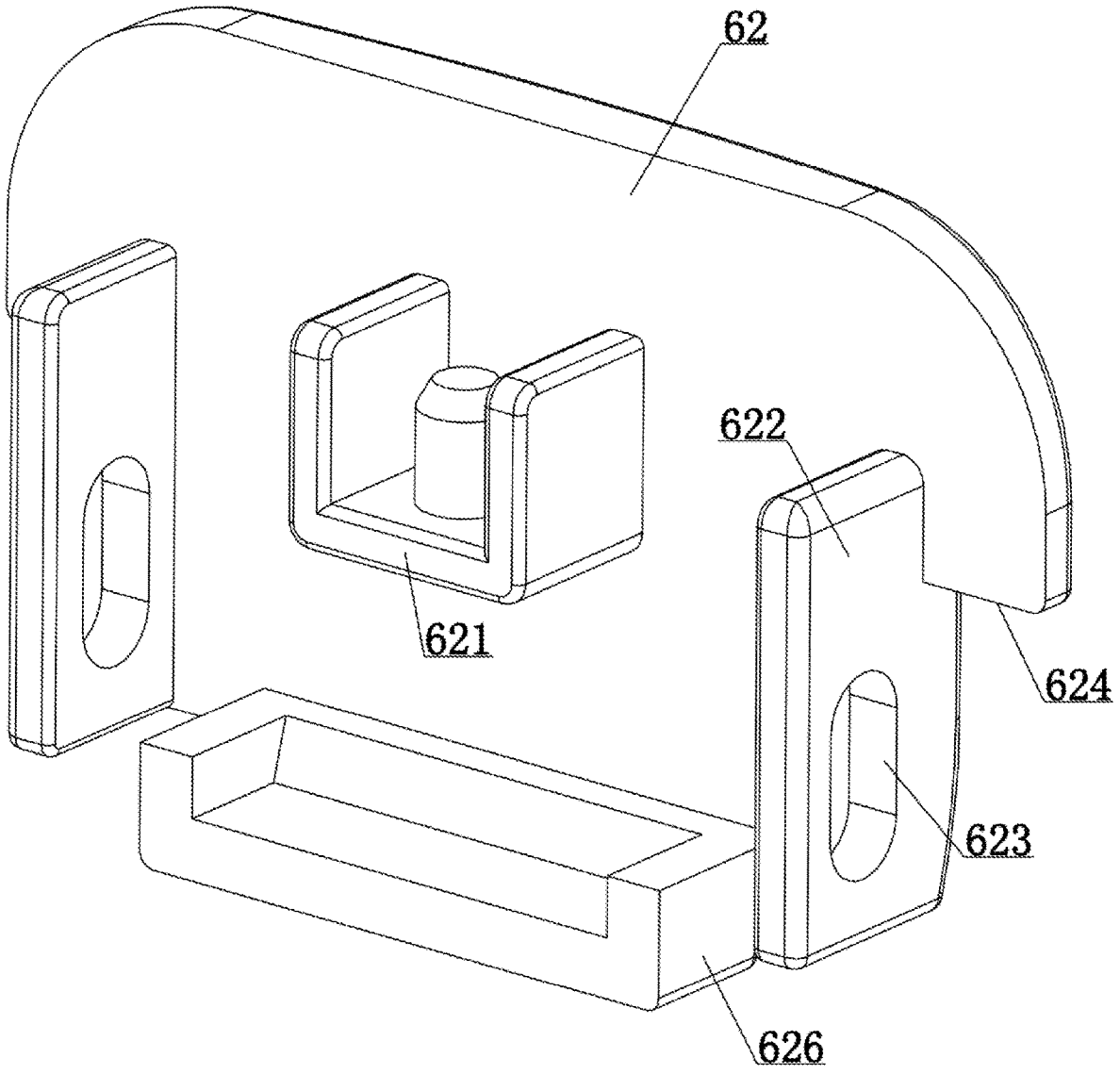
FIG. 5 is a structural view of a pulling portion according to the present invention.
Figure 6:
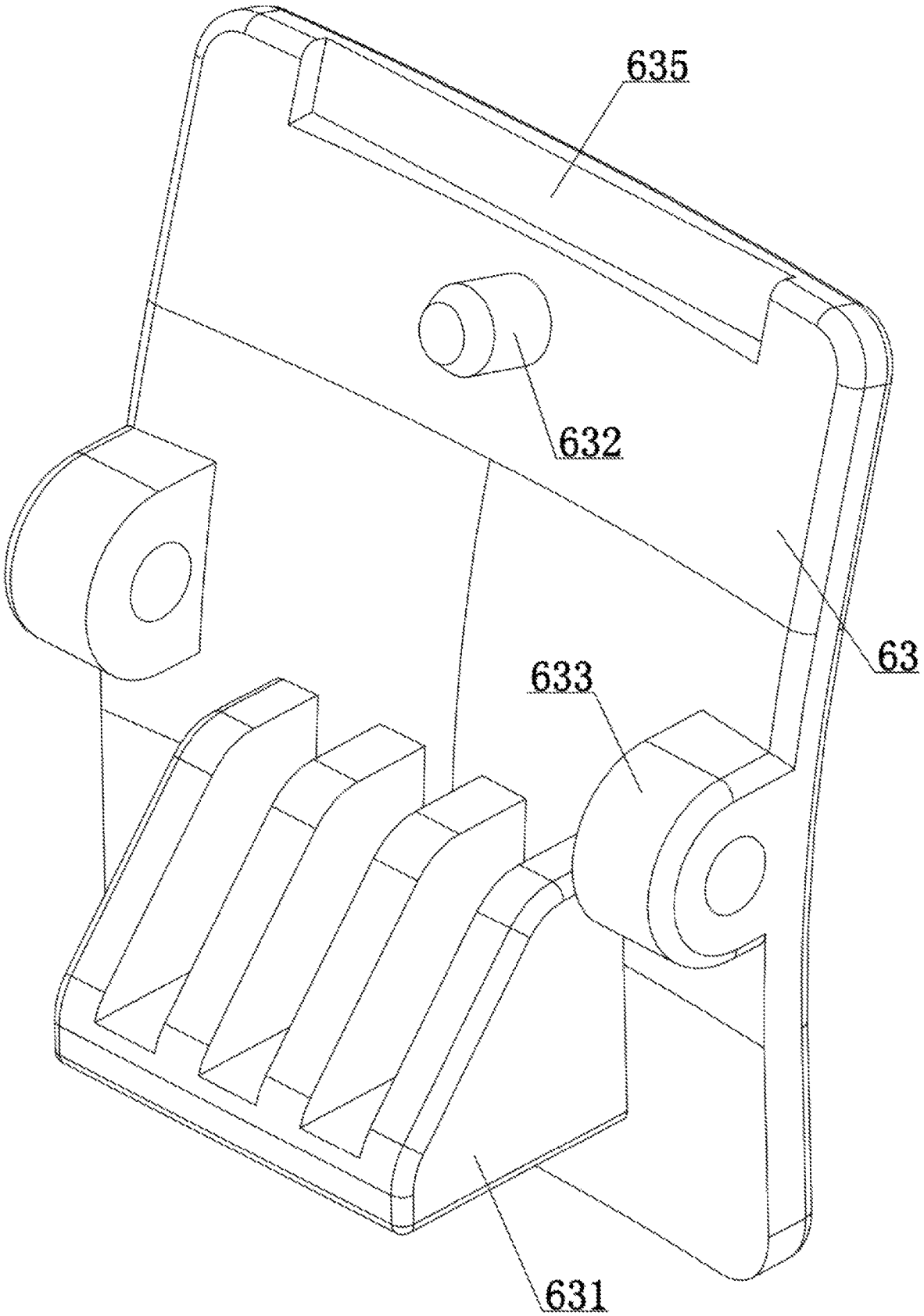
FIG. 6 is a structural view of a pressing portion according to the present invention.

Referring to FIGS. 3 and 4, the bottom portion of the sleeve rod 5 is internally provided with a sleeve piece 7 through which the support rod 4 passes. The sleeve piece 7 is connected to the mounting portion 61. The outer side of the bottom portion of the sleeve rod 5 is provided with a first notch 51 for accommodating a joint between the sleeve piece 7 and the mounting portion 61. Specifically, the sleeve piece 7 and the mounting portion 61 are integrally formed.

Figure 2:
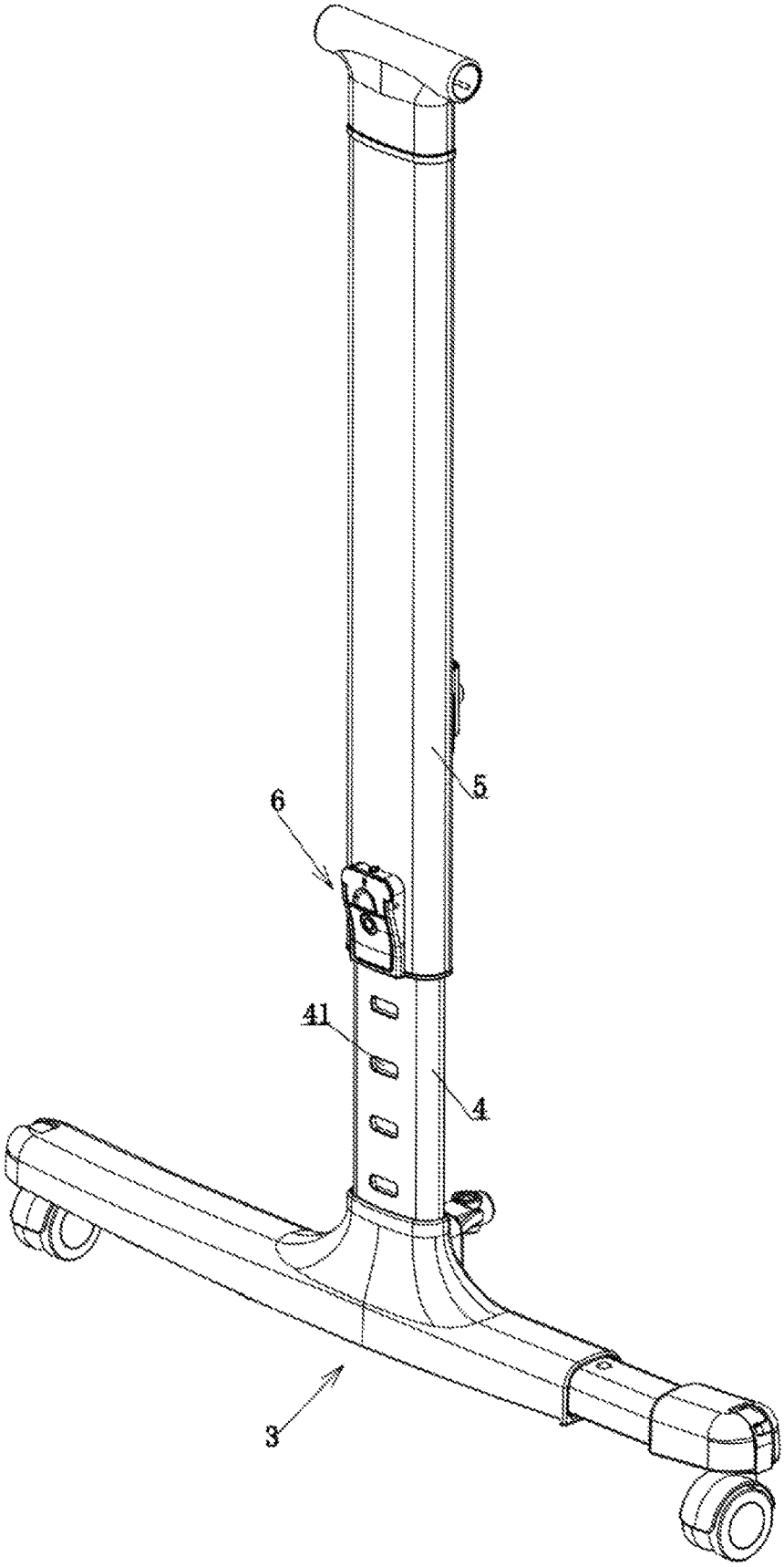
FIG. 2 is a structural view of a left support portion according to the present invention.
Figure 7:
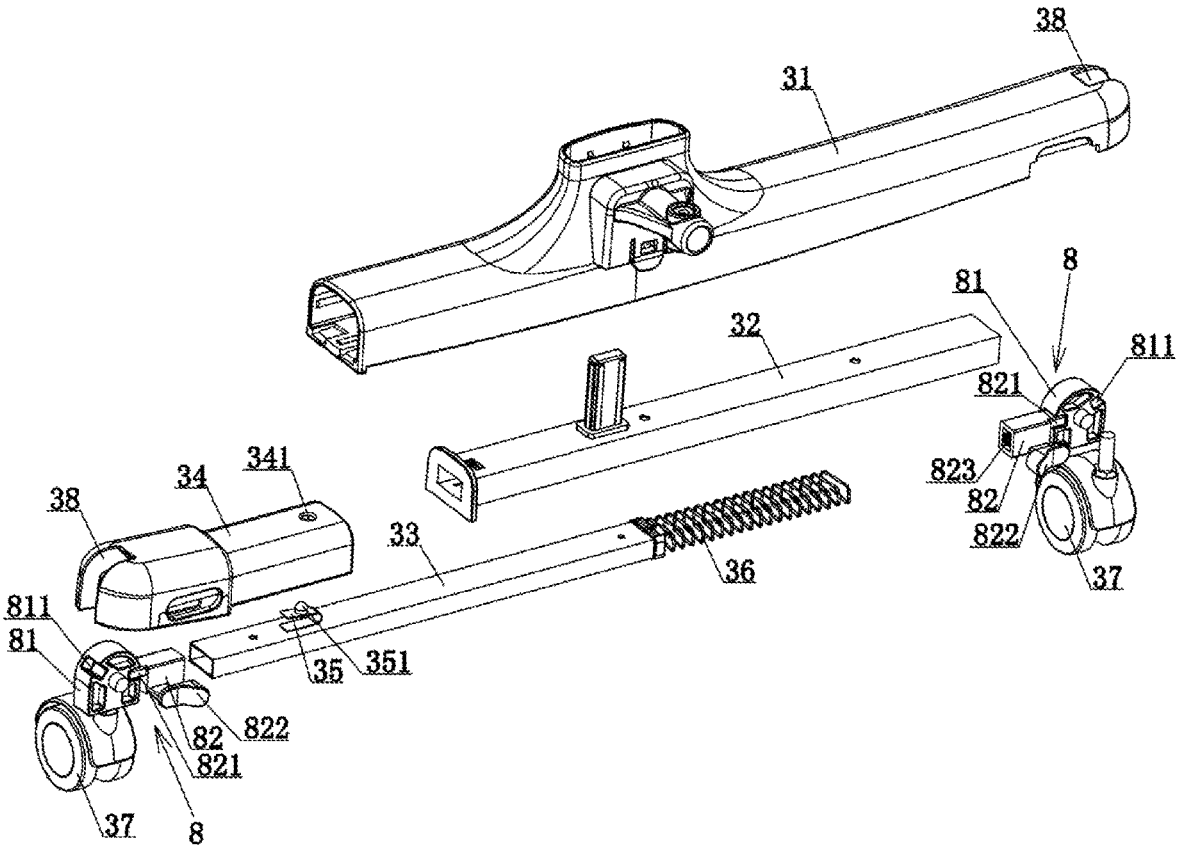
FIG. 7 is an exploded view of a base according to the present invention.

Referring to FIGS. 1, 2 and 7, the base 3 includes an outer tube 31, an intermediate tube 32 and an inner tube 33. The intermediate tube 32 is fixed in the outer tube 31. One end of the inner tube 33 is located in the intermediate tube 32, and the other end of the inner tube 33 extends out of the outer tube 31 and is fixedly connected to one end of a connecting piece 34. The inner tube 33 is retractable relative to the intermediate tube 32. Specifically, the connecting piece 34 is internally provided with an elastic piece slot (not shown in the figure). A top surface of the connecting piece 34 is provided with a clamping hole 341. The elastic piece slot (not shown in the figure) is internally provided with a V-shaped elastic piece 35. The V-shaped elastic piece 35 is provided with a clamping head 351. The clamping head 351 protrudes out of the clamping hole 341 and is located at one side of the outer tube 31. The intermediate tube 32 is internally provided with a third spring 36 abutting against the one end of the inner tube 33.

Referring to FIGS. 1, 2 and 7, the connecting piece 34 and the inner tube 33 are retractable. When it is necessary to place the crib close to an adult bed to take care of the baby, the clamping head 351 of the V-shaped elastic piece 35 is pressed such that the clamping head 351 does not abut against the one side of the outer tube 31. At this time, the connecting piece 34 and the inner tube 33 can be retracted. Then, the crib is tied to the adult bed tightly with a strap. To untie the crib from the adult bed, the strap is loosened. Under the action of the third spring 36, the connecting piece 34 and the inner tube 33 automatically return to their original positions, and the clamping head 351 of the V-shaped elastic piece 35 is re-clamped into the clamping hole 341.

Referring to FIGS. 1, 2 and 7, the outer tube 31 is provided with an arc-shaped bottom surface. Each of one end of the outer tube 31 and the other end of the connecting piece 34 is provided with a rotatable caster 37. Specifically, each of the one end of the outer tube 31 and the other end of the connecting piece 34 is provided with a second notch 38. Each of the one end of the outer tube 31 and the other end of the connecting piece 34 is internally provided with a pivoting assembly 8. The pivoting assembly 8 includes a rotating member 81 and a sliding member 82. A top portion of the caster 37 is connected to the rotating member 81. The rotating member 81 is correspondingly hinged to the outer tube 31/connecting piece 34. An outer periphery of the rotating member 81 is provided with two sockets 811 spaced apart. The rotating member 81 is located in the second notch 38. The sliding member 82 is provided with an insertion portion 821 and a sliding button 822. The insertion portion 821 is able to be inserted into the socket 811. The sliding button 822 protrudes out of the outer tube 31/connecting piece 34. Each of the one end of the outer tube 31 and the other end of the connecting piece 34 is internally provided with a fourth spring 823 abutting against the sliding member 82.

Referring to FIGS. 1, 2 and 7, the crib of the present invention can be used as an ordinary crib or a rocking crib. When the crib is used as an ordinary crib, the caster 37 is in contact with a ground. When the crib is used as a rocking crib, the sliding button 822 is slid such that the insertion portion 821 is disengaged from the matched socket 811. Then, the caster 37 is rotated by a certain angle, and the sliding button 822 is released to allow the insertion portion 821 to be inserted into the other socket 811. At this time, the caster 37 is disengaged from the ground, and the bottom surface of the outer tube 31 is in contact with the ground. Since the bottom surface of the outer tube 31 is an arc-shaped surface, the crib can be rocked.

Referring to FIG. 1, the sleeping basket includes an upper enclosure frame 9, a support frame 10 and an enclosure cloth (not shown in the figure). The upper enclosure frame 9 is provided above the support frame 10. The enclosure cloth (not shown in the figure) is provided between the upper enclosure frame 9 and the support frame 10. The connection relationship between the enclosure cloth (not shown in the figure) and the upper enclosure frame 9 and the support frame 10 is in the prior art, and will not be repeated herein.

Figure 8:
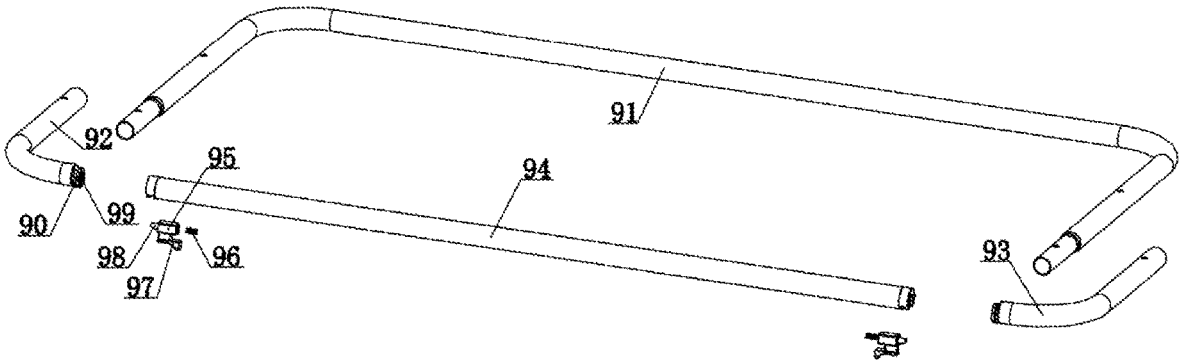
FIG. 8 is an exploded view of an upper enclosure frame according to the present invention.
Figure 9:
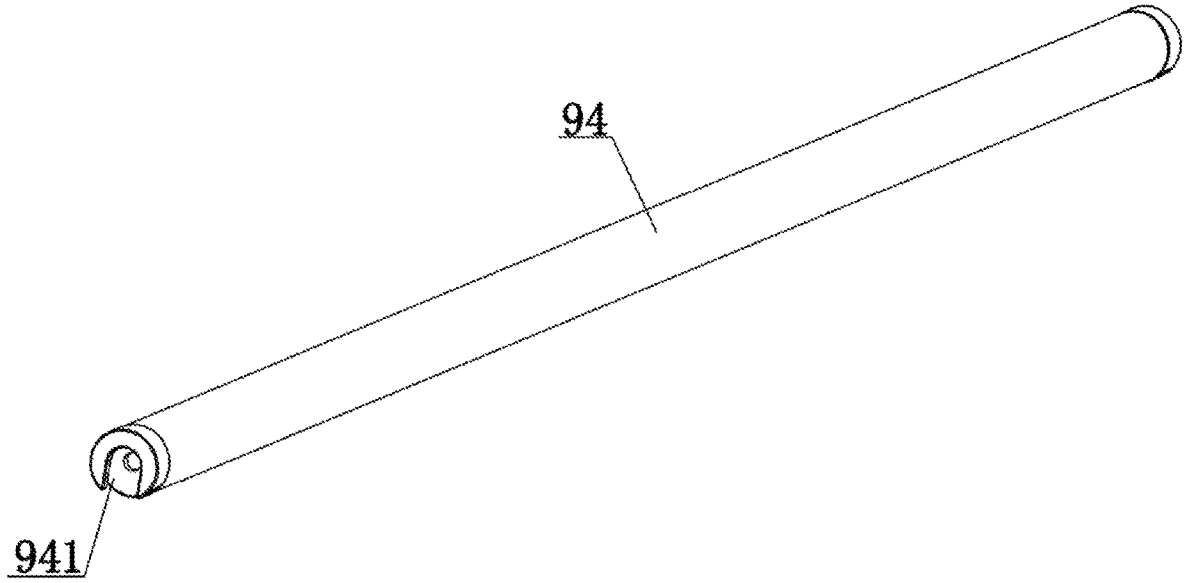
FIG. 9 is a structural view of a detachable tube according to the present invention.

Referring to FIGS. 1, 8 and 9, the upper enclosure frame 9 includes a U-shaped tube 91, a left connecting tube 92, a right connecting tube 93 and a detachable tube 94. Two ends of the U-shaped tube 91 respectively pass through a top portion of the sleeve rod 5 of the left support portion 1 and a top portion of the sleeve rod 5 of the right support portion 2 to be respectively connected to the left connecting tube 92 and the right connecting tube 93. The detachable tube 94 is detachably provided between the left connecting tube 92 and the right connecting tube 93. Each of two ends of the detachable tube 94 is internally provided with a movable member 95 and a fifth spring 96. The movable member 95 has a bottom portion provided with a push portion 97, one end surface provided with an insertion rod 98 and the other end surface abutting against the fifth spring 96. An end surface of each of the left connecting tube 92 and the right connecting tube 93 is provided with an insertion slot 99 for the insertion of the insertion rod 98. An end portion of each of the left connecting tube 92 and the right connecting tube 93 is provided with a positioning portion 90. Each of two ends of the detachable tube 94 is provided with a positioning slot 941 adapted to the positioning portion 90. The detachable tube 94 is detachable from the left connecting tube 92 and the right connecting tube 93. To do so, first, the push portions 97 are pushed to disengage the insertion rods 98 from the insertion slots 99. Then, the detachable tube 94 is raised such that the positioning portions 90 are disengaged from the positioning slots 941.

The above described are merely specific implementations of the present disclosure, but the design concept of the present invention is not limited thereto. Any non-substantial changes made to the present invention based on the concept of the present invention should fall within the protection scope of the present invention.

What is claimed is:

1. A crib, comprising a left support portion, a right support portion and a sleeping basket, wherein each of the left support portion and the right support portion comprises a base, a support rod and a sleeve rod; the support rod is provided with a bottom portion connected to a top portion of the base and an upper portion nested in a lower portion of the sleeve rod; the sleeping basket is provided between the sleeve rod of the left support portion and the sleeve rod of the right support portion; an outer side of a bottom portion of the sleeve rod is provided with a double-lock assembly; the double-lock assembly comprises a mounting portion, a pulling portion for pulling and a pressing portion for pressing; the mounting portion is connected to the sleeve rod; the pulling portion and the pressing portion are arranged on the mounting portion, and the pulling portion is located above the pressing portion; when the pulling portion is not pulled upward, the pulling portion blocks the pressing portion; an inner side of the pressing portion is provided with a clamping portion; an outer side of a lower portion of the support rod is provided with a plurality of clamping slots arranged vertically; and the clamping portion passes through the mounting portion and the sleeve rod to be clamped into a clamping slot of the plurality of clamping slots;

wherein a mounting slot is provided on an outer side of the mounting portion; an inner side of the pulling portion is provided with a spring mounting seat located in the mounting slot and two side plates spaced apart; the spring mounting seat is provided between the two side plates;

the two side plates are respectively provided with strip slots; a first pin connected to the mounting portion passes through the strip slots of the two side plates; middle portions of two sides of the pulling portion are respectively provided with upper clamping edge portions, an upper portion of the mounting portion is provided with two lower clamping edge portions, and the two lower clamping edge portions are corresponding to the upper clamping edge portions. respectively; the upper clamping edge portions are configured to abut against the two lower clamping edge portions, respectively; and a first spring is provided between the spring mounting seat and an inner top surface of the mounting slot.

2. The crib according to claim 1, wherein an inner side of the pressing portion is provided with a spring mounting post and two hinge portions spaced apart; a second pin hinged to the mounting portion passes through the two hinge portions; the mounting slot is internally provided with a spring slot; a second spring is provided between the spring slot and the spring mounting post; and the spring mounting post, the two hinge portions and the clamping portion are respectively located at upper, middle and lower portions of the inner side of the pressing portion.

3. The crib according to claim 1, wherein the base comprises an outer tube, an intermediate tube and an inner tube; the intermediate tube is fixed in the outer tube; a first end of the inner tube is located in the intermediate tube, and a second end of the inner tube extends out of the outer tube and is fixedly connected to a first end of a connecting piece; and the inner tube is retractable relative to the intermediate tube.

4. The crib according to claim 3, wherein the connecting piece is internally provided with an elastic piece slot; a top surface of the connecting piece is provided with a clamping hole; the elastic piece slot is internally provided with a V-shaped elastic piece; the V-shaped elastic piece is provided with a clamping head; the clamping head protrudes out of the clamping hole and is located at one side of the outer tube; and the intermediate tube is internally provided with a third spring abutting against the first end of the inner tube.

5. The crib according to claim 3, wherein the outer tube is provided with an arc-shaped bottom surface; and each of an end of the outer tube and a second end of the connecting piece is provided with a rotatable caster.

6. The crib according to claim 5, wherein each of the end of the outer tube and the second end of the connecting piece is provided with a second notch; each of the end of the outer tube and the second end of the connecting piece is internally provided with a pivoting assembly;

the pivoting assembly comprises a rotating member and a sliding member; a top portion of the rotatable caster is connected to the rotating member; the rotating member is correspondingly hinged to the outer tube/connecting piece; an outer periphery of the rotating member is provided with two sockets spaced apart; the rotating member is located in the second notch; the sliding member is provided with an insertion portion and a sliding button; the insertion portion is configured to be inserted into a socket of the two sockets; the sliding button protrudes out of the outer tube/connecting piece; and each of the end of the outer tube and the second end of the connecting piece is internally provided with a fourth spring abutting against the sliding member.

7. The crib according to claim 1, wherein the sleeping basket comprises an upper enclosure frame, a support frame and an enclosure cloth; the upper enclosure frame is provided above the support frame; the enclosure cloth is provided between the upper enclosure frame and the support frame; the upper enclosure frame comprises a U-shaped tube, a left connecting tube, a right connecting tube and a detachable tube; two ends of the U-shaped tube respectively pass through a top portion of the sleeve rod of the left support portion and a top portion of the sleeve rod of the right support portion to be respectively connected to the left connecting tube and the right connecting tube; the detachable tube is detachably provided between the left connecting tube and the right connecting tube; each of two ends of the detachable tube is internally provided with a movable member and a fifth spring; the movable member has a bottom portion provided with a push portion, a first end surface provided with an insertion rod and a second end surface abutting against the fifth spring; an end surface of each of the left connecting tube and the right connecting tube is provided with an insertion slot for an insertion of the insertion rod; an end portion of each of the left connecting tube and the right connecting tube is provided with a positioning portion; and each of two ends of the detachable tube is provided with a positioning slot adapted to the positioning portion.

8. A crib, comprising a left support portion, a right support portion and a sleeping basket, wherein each of the left support portion and the right support portion comprises a base, a support rod and a sleeve rod; the support rod is provided with a bottom portion connected to a top portion of the base and an upper portion nested in a lower portion of the sleeve rod; the sleeping basket is provided between the sleeve rod of the left support portion and the sleeve rod of the right support portion; an outer side of a bottom portion of the sleeve rod is provided with a double-lock assembly; the double-lock assembly comprises a mounting portion, a pulling portion for pulling and a pressing portion for pressing; the mounting portion is connected to the sleeve rod; the pulling portion and the pressing portion are arranged on the mounting portion, and the pulling portion is located above the pressing portion; when the pulling portion is not pulled upward, the pulling portion blocks the pressing portion; an inner side of the pressing portion is provided with a clamping portion; an outer side of a lower portion of the support rod is provided with a plurality of clamping slots arranged vertically; and the clamping portion passes through the mounting portion and the sleeve rod to be clamped into a clamping slot of the plurality of clamping slots;

wherein a bottom portion of an inner side of the pulling portion is provided with an abutting portion; a top portion of the inner side of the pressing portion is provided with an abutting slot adapted to the abutting portion; and when the pulling portion is not pulled upward, an outer side of the abutting portion abuts against an inner side of the abutting slot.

9. A crib, comprising a left support portion, a right support portion and a sleeping basket, wherein each of the left support portion and the right support portion comprises a base, a support rod and a sleeve rod; the support rod is provided with a bottom portion connected to a top portion of the base and an upper portion nested in a lower portion of the sleeve rod; the sleeping basket is provided between the sleeve rod of the left support portion and the sleeve rod of the right support portion; an outer side of a bottom portion of the sleeve rod is provided with a double-lock assembly; the double-lock assembly comprises a mounting portion, a pulling portion for pulling and a pressing portion for pressing; the mounting portion is connected to the sleeve rod; the pulling portion and the pressing portion are arranged on the mounting portion, and the pulling portion is located above the pressing portion; when the pulling portion is not pulled upward, the pulling portion blocks the pressing portion; an inner side of the pressing portion is provided with a clamping portion; an outer side of a lower portion of the support rod is provided with a plurality of clamping slots arranged vertically; and the clamping portion passes through the mounting portion and the sleeve rod to be clamped into a clamping slot of the plurality of clamping slots;

wherein the bottom portion of the sleeve rod is internally provided with a sleeve piece, wherein the support rod passes through the sleeve piece; the sleeve piece is connected to the mounting portion; and the outer side of the bottom portion of the sleeve rod is provided with a first notch for accommodating a joint between the sleeve piece and the mounting portion.

* * * * *